United States Patent [19]

Steinhauser

[11] 4,430,882

[45] Feb. 14, 1984

[54] MULTI-STAGE METAL-WORKING MACHINE

[75] Inventor: Ulrich Steinhauser, Allschwil, Switzerland

[73] Assignee: Hatebur Umformmaschinen AG., Reinach, Switzerland

[21] Appl. No.: 268,206

[22] Filed: May 29, 1981

[30] Foreign Application Priority Data

Jun. 10, 1980 [DE] Fed. Rep. of Germany ..... 3021695

[51] Int. Cl.[3] ..... B21D 43/05

[52] U.S. Cl. ..... 72/405

[58] Field of Search ..... 72/405, 404, 421, 422

[56] References Cited

U.S. PATENT DOCUMENTS

| | | | |
|---|---|---|---|
| 3,466,917 | 9/1969 | Eakin | 72/405 |
| 3,965,718 | 6/1976 | Kline | 72/405 |
| 4,186,589 | 2/1980 | Criblez | 72/421 |
| 4,351,180 | 9/1982 | Allebach | 72/405 |

FOREIGN PATENT DOCUMENTS

| | | | |
|---|---|---|---|
| 1210969 | 3/1960 | France | 72/405 |

*Primary Examiner*—Gene P. Crosby
*Attorney, Agent, or Firm*—Ladas & Parry

[57] ABSTRACT

A blank (17), which has been sheared off from a coil of wire or from a rod, is rotated through 90°, this rotation being required in connection with the forging of this blank. The gripping-jaws (19, 20), serving for the purpose of transport from one station to the adjacent metal-working station, are attached, for this purpose, to rotating devices (9c, 9d), which are mounted in a manner permitting rotation and are located, on the one hand, on a guide part (7a, 7b) which is driven to reciprocate (A) and to oscillate about an axis (93), and, on the other hand, are anchored to the stationary die-holder (3) via a guiding mechanism (23a, 23b). The guiding mechanism can be regarded as a spatial double-link mechanism, possessing a connecting rod (24), a coupling link (25), a stationary pin-joint (28), a ball-joint (30), and a pin-joint (29a, 29b) which travels with the rotation device (9c, 9d). The components are arranged in such a way that the greatest part of the intended 90° rotation of the blank takes place in the first half of the translational transport movement.

5 Claims, 6 Drawing Figures

MULTI-STAGE METAL-WORKING MACHINE

Figure 1:
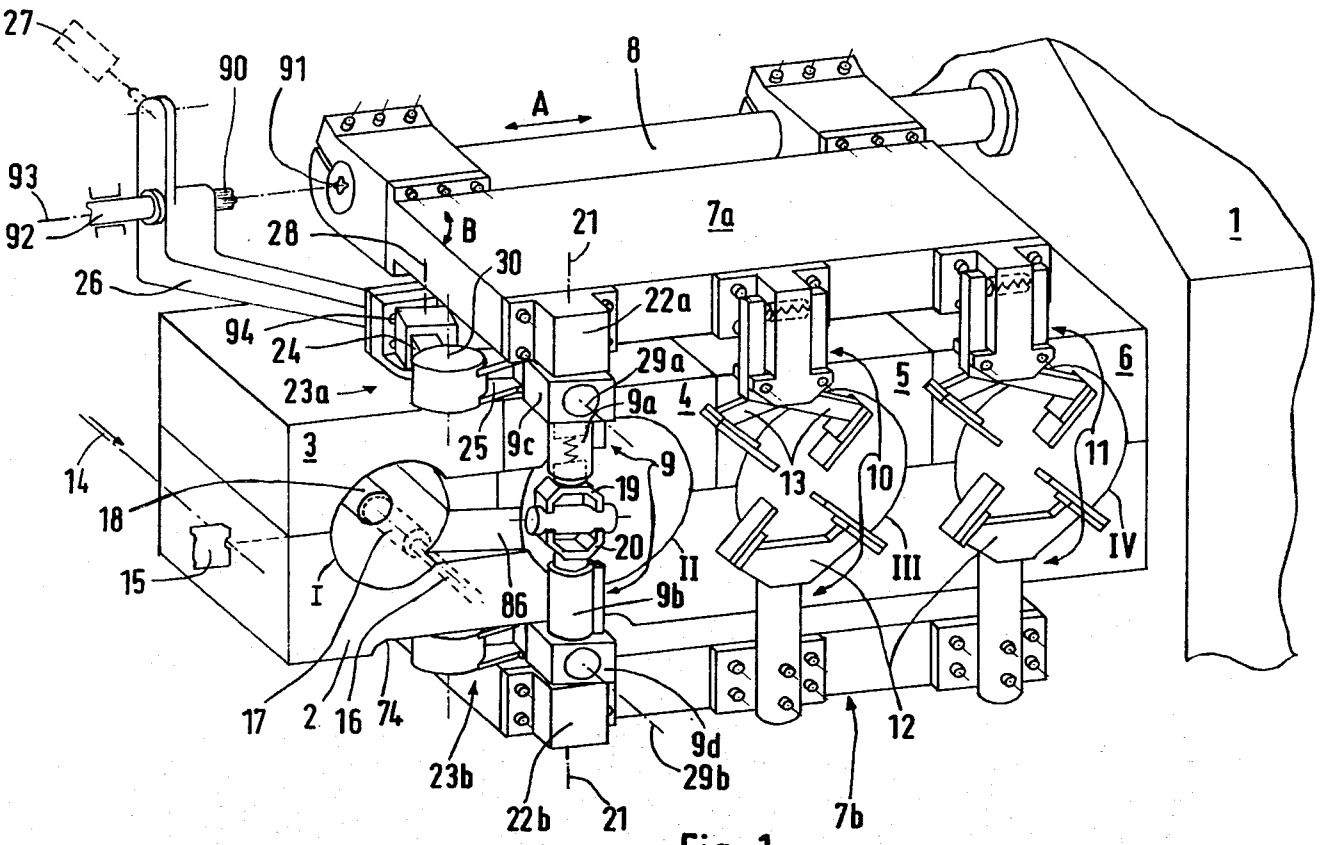

The present invention relates to a multi-stage metal-working machine for working metal blanks without cutting, the blanks being rotated through virtually 90° during transfer from one station to the adjacent station, rotating taking place about a rotation axis running transversely to the longitudinal extension of the blanks and transversely to the pressing direction, a pair of gripping-jaws being provided for transporting the blanks between the two adjacent stations, the two gripping-jaws of the said pair of jaws being attached, via gripping-jaw carriers, to guide parts, the latter being rigidly coupled, in their turn, to a main shaft, which is driven to reciprocate and to oscillate about its own axis.

In the case of conventional multi-stage metal-working machines, which shape parts directly from coiled wire or rods, the starting material is pulled against a stop beside the press slide, in the direction of the pressing axis, and is sheared off by means of a shear blade. In this operation, the shear carriage simultaneously serves as a device for feeding the sheared-off blank into a position in front of the 1st metal-working station, or into a loading station, the longitudinal axis of the blank remaining parallel to the pressing axis.

If now the intention is to form a pressure-forged part having a transverse dimension, especially in one direction, which is many times greater than the longitudinal dimensions, the production of such parts on multi-stage presses of this type can be very difficult, or even impossible, on account of the high degree of working and the consequent high forging forces.

Devices on metal-working machines of this type are admittedly known by means of which it is possible to rotate blanks and/or pressure-forged parts through 180°. However, the rotary movement which can be achieved with the aid of these known devices unavoidably progresses in a manner such that to each segment of the path which is travelled in translation there corresponds an identical fraction of the entire rotation angle. However, if at all possible, the rotation should already be largely complete over the last third of the transport movement, or at least concluded with the exception of a slight residual rotation, in order to avoid colliding with the adjacent die, or to avoid a modification to the design of the die.

The object of the present invention is accordingly to propose a device for rotating a blank through virtually 90°, this device rotating the blank through larger angular units at the start of the translational movement than in the last portion of this movement, so that the blank has already been rotated, for example, at the half-way point, by considerably more than 45°, for example by 60°. At the same time, the device is intended to be additionally distinguished from the known designs through the simplicity of its construction.

This object is achieved, according to the invention, by means of the combination of features defined in the independent Patent Claim 1. Preferred embodiments are defined in the dependent Claims.

Figure 2:
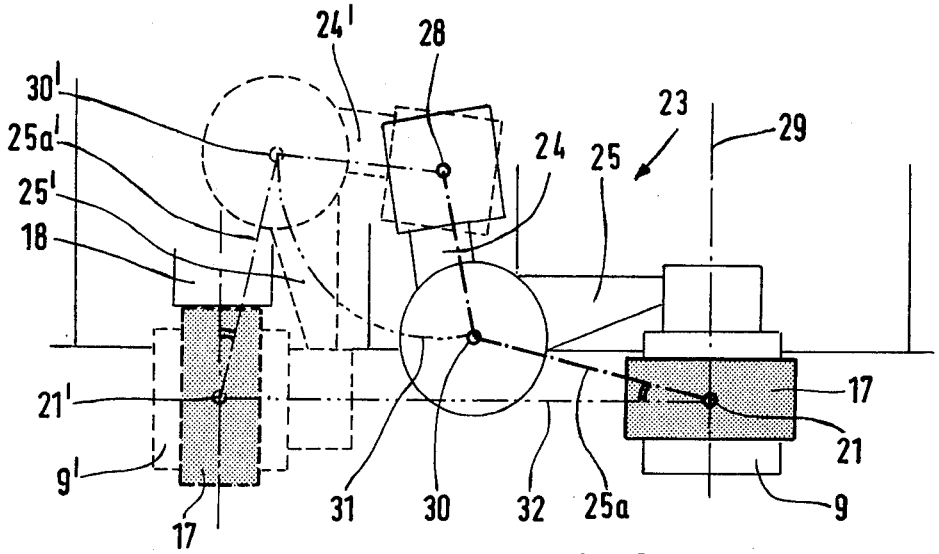
Figure 3:
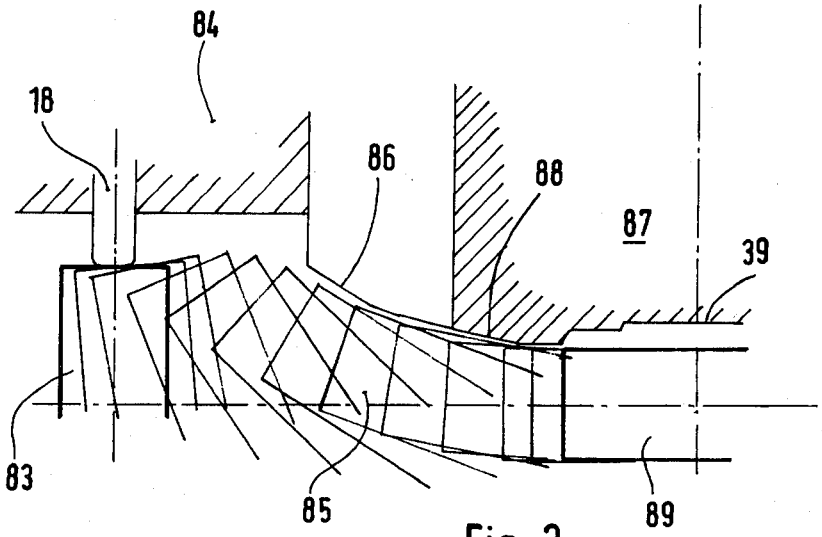
Figure 4:
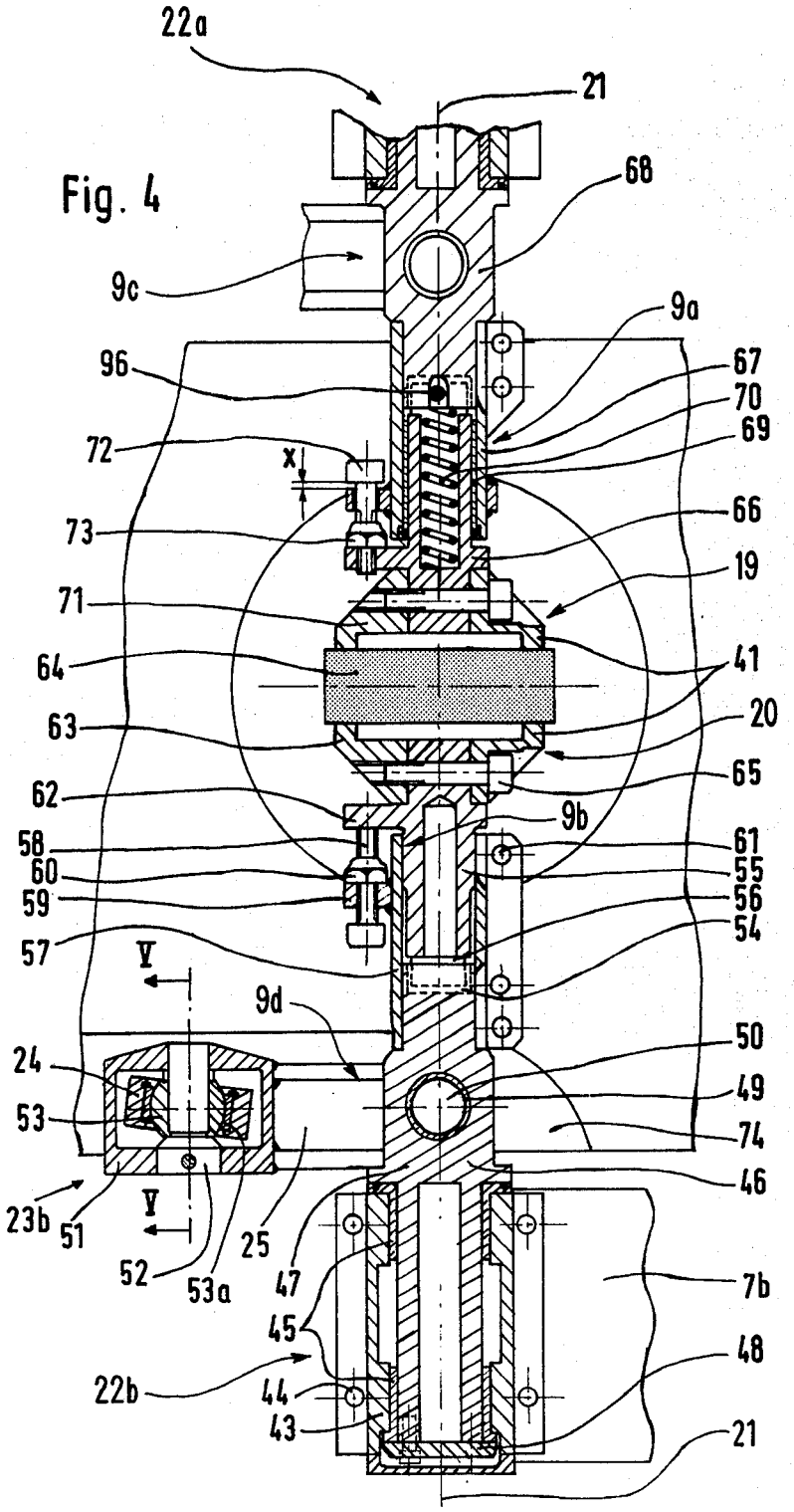
Figure 5:
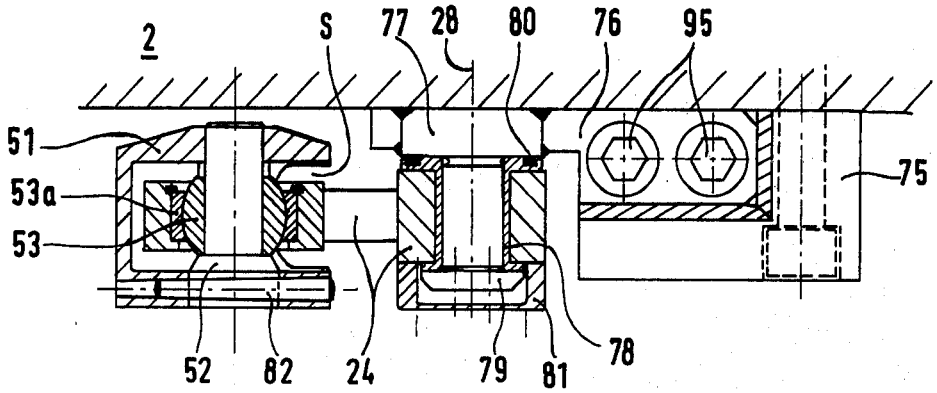
Figure 6:
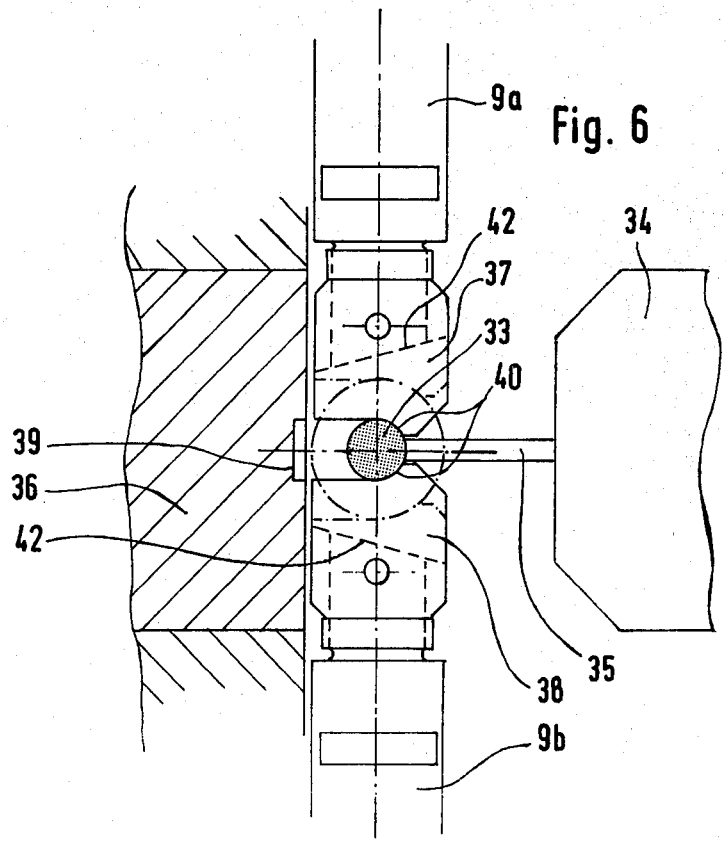

In the test which follows, the invention is described with the aid of an illustrative embodiment, reference being made to the attached drawing, in which:

FIG. 1 shows a simplified perspective representation of that part of a four-stage metal-working machine which is relevant in the present context, FIG. 2 shows a diagrammatic illustration of the course followed in the movement of the guiding mechanism which is used, FIG. 3 shows various phases of the rotational movement of the blank, FIG. 4 shows a vertical section along a plane lying in the axis of the gripping-jaws, FIG. 5 shows a vertical section along the line V—V in FIG. 4, and FIG. 6 illustrates the design of the gripping-jaws for the smallest blank and for the largest blank.

According to FIG. 1, a lower die-holder 2 is attached to a press-frame 1, the said holder having four recesses for receiving dies. Four die-holder covers 3,4, 5 and 6 are attached above the die-holder. Gripping-jaw carrier boxes *7a*,*7b* are located above and below these die-holder devices. These gripping-jaw carrier boxes are each attached, by means of a clamp-connection, to a shaft 8 and have the function of connecting the gripping-jaw devices, which are still to be described, to the shafts 8 of which only the upper one can be seen. Each of these shafts 8 is mounted in the press-frame 1 in a manner permitting rotational and longitudinal movement, and both are precisely synchronised to move together in the direction of the arrow "A" and to move in opposite directions as indicated by the arrow "B", "A" representing a translational movement in the direction of the axis 93 of the shaft, and "B" representing an angular movement about the same axis. A drive mechanism, which is not shown, imparts the movement to these shafts which is necessary in order to transport the forgings from one metal-working station to the next and for the empty return movement.

This sequence of movements takes place in two parts: on the one hand, as a transverse transporting movement of the forgings from one die to a position in front of the next (Arrow A), and on the other hand for opening and closing the gripping-jaws and, as the case may be, for gripping or releasing the forgings (pivoting movement about the shaft 8, Arrow B).

Three pairs of gripping-jaws 9, 10, 11 are detachably fastened to the front face of the gripping-jaw carrier boxes *7a*,*7b*. Whilst now the pairs of gripping-jaws 10 and 11 correspond to the known form and are provided with stationary lower gripping devices 12 and upper gripping devices 13 which are supported in a resilient manner, the first pair of gripping-jaws has been replaced, in each case, by two gripping-jaw carriers 9*a* and 9*b*.

The wire or the rod is pulled in, in the axis 14, in the direction of the arrow, against an adjustable stop, which is not shown, by means of which the length to be cut off is set, and the wire or rod is sheared off by means of the shear blade 15 which is represented diagrammatically.

The sheared-off section is securely held by means of a device on the shear blade 15, this device not being shown, and the sheared-off section is brought to a position in front of the first station. In the case of the present illustrative embodiment, this station is not the first metal-working station, but is purely a holding station, in which the section is held until it is acquired by the gripping-jaw carriers 9*a* and 9*b*. A resiliently supported holding-pin 16, projecting from the first forging tool of the advancing press slide, pushes the sheared-off blank 17 out of the holding device on the shear blade, and against a stop-bolt 18, which has been fitted in place of a first die into the aperture provided for a die. The holding-pin 16 holds the blank until the pair of gripping-jaws, marked 9 in their entirety, which have moved, with the transverse transport carriers, into the left-hand end position, have gripped the blank by means of the pivoting movements "B," whilst the press slide, which cannot be seen and should be imagined as being in front of the plane of the drawing, returns to its rearward position and thereby also withdraws the holding-pin 16 as it does so. The transverse transport carriers are now moved into their right-hand end position. During this movement, an upper gripping device 19 and a lower gripping device 20, which can rotate in the retaining bearings 22*a* and 22*b* respectively, each rotate by 90° about the vertical axis 21. This rotational movement is imparted to the gripping devices, in each case, by a spatial drive mechanism, that is to say by a double-link mechanism 23*a* and 23*b* which can move in three dimensions and has the function of a guiding mechanism with the task of forcibly guiding the gripping-jaws 9 holding the blank 17 in such a way, during their translational movement, that, on the one hand, the blank is rotated through 90° with respect to the vertical axis 21 and, on the other hand, this rotation is matched to the translational movement in such a manner that a major part of the angular movement already takes place during the first half of the translational path followed by the gripping-jaws. By this means, the intention is to ensure that the necessary guiding mechanism requires as a little space as possible for its movement and, in particular, to ensure that no constructional changes, such as, for example, recesses, need be provided in the adjoining die-housing, or, if any changes are made, they will be of an insignificant nature.

Each of the spatial double-link mechanisms is composed of a connecting rod 24 and a coupling link 25. At its rear end, the connecting rod 24 possesses a bearing bush, which is mounted to rotate about the stationary axis 28, according to FIG. 5, on a stationary pin. The connection between the coupling rod 24 and the coupling link 25 is formed by a ball-joint 30, whilst at its other end the coupling link 25 possesses a pivot pin which engages into the rotation device 9*c*, 9*d* of the gripping-jaw 9, comprising top part 9*c* and bottom part 9*d*, which parts can be pivoted about the axis 21, and is there mounted so that it can rotate about the axis 29*a* (top) or 29*b* (bottom).

FIG. 2 diagrammatically shows the representation of the sequence of movements of the spatial double-link mechanism, projected onto a horizontal plane. The solid lines show the position of the guiding mechanism when the transverse transport is located in the right-hand end position and the forging 17 is thus located, rotated through 90°, at a position in front of the metal-working station, whilst the left-hand end position is represented by broken lines, the forging thus still being in the position where it was brought, by the shear blade, into the loading station.

The connecting rod 24 is thus placed, at one of its ends, on a stationary bearing, on which it can rotate about the vertical axis 28. This arrangement allows the other end, which is connected to the coupling link 25 by means of the ball-joint 30, to move on a circular arc 31, indicated in FIG. 2 by a dash-dot-dot-dash line. At its end on the side of the gripping devices, opposite the ball-joint 30, the coupling link 25 is provided with a pivot pin which engages into the part 9*c* or 9*b* of the device 9, it being possible for these parts to rotate about the vertical axis 21, and can rotate about the axis 29*a*/29*b*.

If the gripping-jaw carrier, guided in a straight line by the shaft 8, now moves from the left-hand end position (the double-link mechanism 23 thus being in the position represented by broken lines) into the right-hand end position (represented in FIG. 2 by unbroken lines), the rotation axis of the gripping-jaws thus moves, along the line 32, from 21' to 21, and the position of the ball-joint follows the circular arc 31, from 30' to 30. As a result of the chosen geometry, the coupling link 25, which is guided, on the one hand, on the arc 31 and, on the other hand, on the straight line 32, is rotated through 90°, at least provided that the mechanism (as represented in FIG. 2) moves in the plane of projection, represented by the line-segment 25*a' and 25a.* Since now the pivot pin, which forms the axis 29 and is secured in the coupling link 25, engages into the device 9, which can rotate about the vertical axis 21, this device is consequently also rotated through 90°.

FIG. 6 shows how the blank 33, which has been rotated, is acquired by the sprung pin 35 and the die 36, the former being incorporated in the second forging tool 34 of the press slide. By advancing the press slide 34, the blank 33 is pushed, by the sprung pin or pins 35, out of the gripping-jaws 37,38, until the blank bears on the impression-area 39 of the die. The shape of the gripping-jaws 37,38 is designed so that the blank can be ejected, on the die side, but is guided until it is pressed against the impression-area 39 of the die 36, whilst bearing, on the other side, against a shoulder 40. When once the blank 33 is held by means of the sprung pin 35, the upper and lower gripping-jaw carrier boxes pivot towards, about the shaft 8, by a certain amount (Arrow B, FIG. 1), and the gripping-jaws thus release the blank, that is to say, the jaws open and thereby make room for the advancing forging tool 34. On acount of the upward pivoting of the gripping jaw carrier boxes during the return movement into the starting position, it is necessary to design the joint 30 as a ball-joint and to design the coupling link 25 to be capable of rotation about the axis 29, at the point at which the said coupling link is coupled to the rotation device comprising parts 9*c* and 9*d*, on which the gripping-jaws 37 and 38 respectively are located. Reverse rotation of the gripping jaws 9, into the starting position, is thereby ensured, even when the gripping-jaws are open. The rotatable device 9 is rotated through a small angle, which exerts no influence, as a result of the upward pivoting movement which has been described and which causes the gripping-jaws to open, the said small angle being precisely compensated againt during the return pivoting movement, that is to say, during closing of the gripping-jaws.

FIG. 6 shows the design of the gripping-jaws for the largest blank (dash-dot line) and for the smallest blank. The areas between the bearing surfaces 41 (FIG. 4) are inclined in order to avoid accumulation of dirt.

FIG. 4 shows a central vertical section through the pair of gripping-jaws 9. A bearing holder 43 is mounted on the gripping-jaw carrier box 7*b* by means of screws 44. Two plain bearing-bushes 45 are located in the bearing holder 43, the rotating part 46 of the gripping-jaw unit being mounted in these bushes. The axial position is defined by a shoulder 47 and by a cover 48, which is screwed onto the lower end of the rotating part 46. Above the mounting of the rotating part 46 the latter has an opening for a bearing-bush 49, into which a pin 50 rotatably engages, this pin being rigidly connected to the coupling link 25. The coupling link 25 could surround the pin 50 from the two end-faces, in the manner of a fork. In order to exclude the risk of contamination, the coupling link 25 acts, as can be seen, inter alia, from FIG. 1, on the pin 50 from one side only, the coupling link being attached to the pin by known means. A housing 51 is also rigidly connected to the coupling link 25, this housing having a rearward-pointing slot s (FIG. 5) and serving as a means for retaining the ball-joint pin 52. A ball 53 surrounds the ball-joint pin 52. The connecting rod is provided with a spherical insert 53*a*, which surrounds the ball 53 and which can be twisted, in a known manner, with respect to the ball.

Two parallel surfaces 54 are milled on the upper part of the rotating part 46, the gripping-jaw carrier 55 having a slot 56 which compliments these surfaces, so that the gripping-jaw carrier 55 engages over the two surfaces 54. The correct position of the gripping-jaw carrier 55 with respect to the rotating part 46 is thereby guaranteed, and the two parts are secured against twisting relative to each other. A clamping-sleeve 57 serves as the connection between the rotating part 46 and the gripping-jaw carrier 55, this clamping-sleeve connecting the rotating part 46 and the gripping-jaw carrier 55 in a secure manner, that is to say, in a manner which is torsionally rigid. An adjusting screw 58 serves to adjust the height of the gripping-jaw carrier in a precise manner, this screw being screwed into an eye 59 which is rigidly connected to the clamping-sleeve 57, it being possible after loosening a locking-nut 60 and a clamping-screw 61 to turn the said adjusting screw and thereby to adjust the height of the stop 62 which is integrally formed on the gripping-jaw carrier 55. The gripping-jaw 63 which serves to hold the blank 64 is mounted on the gripping-jaw carrier by means of a screw 65, the correct position being guaranteed by appropriate guide surfaces.

The upper half of the gripping-jaw device is, in principle, constructed in the same manner as the lower half, but with the difference that it is resiliently mounted in the axial direction, that is to say, in the vertical direction. The upper gripping-jaw carrier 66 is accordingly mounted in a bush 69, in a manner allowing longitudinal movement, by means of a sleeve 67, which is coupled only to the rotating part 68 by means of a clamp-connection. A spring 70, guided in a central hole in the gripping-jaw carrier, presses the latter, and hence the gripping-jaw 71, against the blank 64. The spring travel X is adjusted by turning a screw 72, after releasing a locking-nut 73. A transverse pin 96 is fitted at the upper end of the clamping-jaw carrier 66 in order to prevent the spring from shooting out when the clamping-jaw carrier 66 is dismantled. The attachment to the upper gripping-jaw carrier is identical to that below, and the rotary drive is likewise identical.

The die-holder 2 must be provided with a recess 74 (FIGS. 1 and 4) in the region of the first die to provide space for the rotary drive 23*a*/23*b* between the die-holder 2 and the lower gripping-jaw carrier box 7*b*.

FIG. 5 shows, by means of a vertical section, the stationary bearing of the lower spatial double-linked rotary drive. A bracket 75 is rigidly screwed, at the bottom, to the die-holder 2. A retaining plate 76 is detachably secured to this bracket 75, which serves as an assembly aid. A bearing pin 77 is rigidly attached to this retaining plate 76. The connecting rod 24, provided with a bearing-bush 78, is placed over the bearing pin 77, and is secured by means of a cover 79 which is screwed onto the bearing pin 77. In order to prevent penetration of dirt, the bearing-bush 78 is provided, at the top, with a seal 80, whilst the bearing is closed at the bottom by means of a cover 81. This mounted enables the connecting rod 24 to rotate about the axis 28 (FIG. 2). The ball-joint can be seen at the other end of the connecting rod 24, this joint having already been described with reference to FIG. 4. Here it can be seen how the ball-joint pin 52 is secured to the housing 51 by means of a taper-pin 82, the said housing being rigidly connected to the coupling link 25.

The upper stationary bearing is mountad on a retaining yoke 26 (FIG. 1). This yoke is pressed onto the die-holder cover 3, and thus held stationary, by means of a hydraulically actuated cylinder 27, which simultaneously serves to pivot the upper gripping-jaw carrier box 7*a* in the upward direction.

It is a requirement, in the case of this device, that, when the blank is thrust into the first station, up to the stop 18 (FIG. 1), its mid-point or centre of gravity must be located in the rotation axis 21 of the pair of gripping-jaws 9. This requirement means that when the length which is cut off in the shearing-off operation is changed, the depth to which the blank penetrates into the 1st station must also change, that is to say, the stop 18 must be adjusted. If the cut length is shortened by the amount a, the stop must be set forward by the amount a/2. In accordance with the present example, the stop 18 is mechanically or electrically coupled to the device for adjusting the length which is cut off, so that the position of the stop 18 always corresponds to the length which is cut off and the centre of gravity of the blank is always at the same distance from the front side of the die as the rotation axis 21 of the rotating device 9.

FIG. 3 shows the sequence of movements of the rotating blank. When the transverse transport device is in the starting position, the blank 83 bearing against the stop-bolt 18, which is installed in a filler-piece 84, this filler-piece being inserted in place of the normal forging die in the opening provided for the latter. Rotation of the blank is also started as soon as the transverse transport movement commences. The filler-piece 84 is set back with respect to the normal front edge of the die, in order to leave space for the long blank. It can be seen from the figure that the rotating blank 85 would collide with the die-holder 2. A recess 86 is accordingly located at that point. In addition, the die 87, which is inserted into the 2nd station, has another small adaptation 88. This adaptation 88 can be kept so small because the blank, on account of the choice of the spatial double-linkage as the rotary drive and on account of the geometric arrangement of the articulated joints, has already rotated through considerably more than 45°, through approximately 60° in the case of the present example, before having completed half the translational stroke. The die 87 is thereby subject to virtually no limitation and is consequently a fully valid forging die.

In order to obtain good accessibility for working in the tool space, the upper gripping-jaw carrier box 7*a* can be pivoted in the upward direction, about the shaft 8 (FIG. 1). In order to do this, the shaft 8 is uncoupled from the drive mechanism, which is not shown, and is pushed beyond the left-hand starting position (1st gripping-jaw in front of the 1st die), until the protruding profile-section piece 90 projects into the matching opening 91, the said profile-section piece being designed as a continuation of the shaft 92, on which the bearing retaining-yoke 26 is attached and which is mounted in the same axis 93 with the shaft 8. The upper gripping-jaw carrier box 7*a* can then be pivoted upwards by means of the cylinder 27. The bearing retaining-yoke 26 rotates with the said box, together with the rotary drive 23. The upper gripping-jaw carrier box *7a* can consequently be pivoted upwards without any difficulty.

For retooling for conventional metal-working, that is to say, without rotating the blank, the rotatable device 9 can be replaced by a pair of gripping-jaws of the original type (pattern 10, 11, FIG. 1). The rotary drive 23 remains on the gripping-jaw units, that is to say, the upper drive is separated from the bearing retaining-yoke 26 by releasing the screws 94(sic), whilst the lower rotary drive is separated from the guide device by releasing screws 95 (FIG. 5). Rapid retooling for forging conventional parts is thereby ensured.

In the case of the illustrative embodiment described in the preceding text, a preliminary holding station I has been interposed between the shearing-off station and the first metal-working station II, the main function of this preliminary holding station being to hold the sheared-off length of material until it has been securely gripped by the gripping-jaws 19 and 20. It would, however, be entirely possible to carry out a forging operation already in the 1st station. It would also be possible to attach the turning device, which has been described, quite generally between any two stations which are adjacent to each other, for example between the metal-working stations III and IV.

The illustrative embodiment shows a multi-stage metal-working machine in which the forging die moves horizontally. The principle which is being claimed can, however, also be applied, in the same way, to machines which operate vertically.

According to a preferred embodiment of the invention, the two gripping-jaws 19 and 20 (FIG. 1) are coupled to a guiding mechanism 23. It would, however, also be possible to guide only one gripping-jaw in a forcible manner, via a guiding mechanism of this type, and to arrange that the other gripping-jaw be capable of rotating freely.

I claim:

1. Multi-stage metal-working machine for working metal blanks, the blanks being rotated through virtually 90° during transfer from one station to the adjacent station, rotation taking place about a rotation axis (21) running transversely to the longitudinal extension of the blanks and transversely to the pressing direction, a pair of gripping-jaws being provided for transporting the blanks between the two adjacent stations, the two gripping-jaws (19,20) of the said pair of jaws being attached, via two gripping-jaw carriers (*9a*,*9b*) to gripping-jaw carrier boxes (*7a*,*7b*), each of the latter being rigidly coupled to a main shaft (8), which is driven to reciprocate (A) and to oscillate (B) about its own axis, each of the two gripping-jaw carriers (*9a*,*9b*) being connected, in a torsionally rigid manner, to a rotation device (*9c*,*9d*) which is mounted in a manner allowing rotation about the rotation axis (21), one end of a guiding mechanism (*23a*,*23b*) acting on the said rotation device (*9c*,*9d*) and the other end of the guiding mechanism being anchored at a point which is fixed with respect to the gripping-jaw carriers (*9a*,*9b*), this other end possessing a connecting rod (24) and a coupling link (25), the coupling link (25) being connected to the connecting rod (24) via an articulated coupling (30,53) which permits the coupling link (25) to execute compound angular movement and the said coupling link (25) additionally acting on the rotation device (*9c*,*9d*) via an articulated joint (50), the latter ensuring that the rotation device (*9c*,*9d*) is driven by the coupling link (25), in a torsionally rigid manner, in the sense of rotation about the rotation axis (21), whilst on the other hand allowing, with regard to opening and closing movement of the gripping-jaws, mutual pivoting of the rotation device (*9c*,*9d*) and the coupling link (25) in a plane passing through the rotation axis (21) in such a way that the coupling (30, 53) is guided, under the influence of translational movement of the gripping-jaw, carriers (*9a*,*9b*) on a circular arc about a stationary axis (28) of the end of the connecting rod (24) and, as this occurs, rotates the rotating device (*9c*,*9d*) and hence the gripping-jaw carrier (*9a*, *9b*) and the gripping-jaw (19, 20) through 90°.

2. Metal-working machine according to claim 1 characterized in that the articulated coupling 30,53 which is located between the coupling link (25) and the connecting rod (24), is a ball-joint.

3. Metal-working machine according to claim 1, characterised in that the coupling link (25) is of fork-shaped design at its end facing the rotation device (*9c*,*9d*) and thereby surrounds a pin (50) which passes through the rotation device (*9c*,*9d*), whilst the other end of the coupling link (25) forms a housing (51), the connecting rod (24) engaging around a pin (52) of this housing via the coupling (30,53).

4. Metal-working machine according to claim 1, in which the metal-working operation is carried out in the horizontal direction, characterized in that an end of the guiding mechanism (*23a*, *23b*) is attached to a yoke (26), which is pivotable mounted on a shaft (92), which can, be coupled to the main shaft (8) via a disconnectable coupling (90), in such a way that the gripping-jaw carrier box (*7a*), including the guiding mechanism (*23a*), can be pivoted upwards, about the main shaft (8), by means of an actuating element (27) which acts on the yoke (26).

5. Metal working machine according to claim 1, in which it is intended that the rotation be effected before the first metal-working station, characterised in that a preliminary holding station (I) is interposed between a shear blade (15) and the first metal-working station (II), the blank (17) being held, when in this preliminary holding station, between a stop-bolt (18) and a movable holding-pin (16).

* * * * *